United States Patent [19]

Sato et al.

[11] Patent Number: 4,626,174

[45] Date of Patent: Dec. 2, 1986

[54] TURBINE BLADE

[75] Inventors: Takeshi Sato, Hitachi; Akira Uenishi, Mito; Norio Yasugahira; Katsukuni Hisano, both of Hitachi, all of Japan

[73] Assignee: Hitachi, Ltd., Tokyo, Japan

[21] Appl. No.: 721,469

[22] Filed: Apr. 9, 1985

Related U.S. Application Data

[63] Continuation-in-part of Ser. No. 544,727, Oct. 24, 1983, abandoned, which is a continuation of Ser. No. 129,200, Mar. 11, 1980, abandoned.

[30] Foreign Application Priority Data

Mar. 16, 1979 [JP] Japan ..... 54-29920

[51] Int. Cl.[4] ..... F01D 5/14

[52] U.S. Cl. ..... 416/223 A

[58] Field of Search ..... 415/DIG. 1, 199.5, 212 A; 416/223 A, 223 R

[56] References Cited

U.S. PATENT DOCUMENTS 1,749,528 3/1930 Freudenreich et al. ..... 416/223 A
3,475,108 10/1969 Zickuhr ..... 416/223 A
3,953,148 4/1976 Seippel et al. ..... 416/223 A

OTHER PUBLICATIONS

Kuethe, A. M., et al., "Foundations of Aerodynamics", John Wiley, N.Y., 1967; pp. 75–89.

*Primary Examiner*—Louis J. Casaregola
*Attorney, Agent, or Firm*—Antonelli, Terry & Wands

[57] ABSTRACT

A turbine blade of a low blade profile loss with a crossing point of an inlet angle $\alpha_1$ an outlet angle $\alpha_2$ being located in a position in which a distance between a crossing point of the outlet end of the blade is greater than one-half of the blade width $L_{ax}$, with the inlet angle $\alpha_1$ being in the range of 35°–40° and the outlet angle $\alpha_2$ being in the range of 25°–28°. A ratio of a narrowest width $S_2$ of the flow channel at the blade outlet end to a narrowest width $S_1$ of a flow channel defined between a backside of the blade in an area of the crossing point and a front side of adjacent blade lies in the range of 0.81–0.96. A ratio of a distance $L_{ax}$ to a blade width $L_{ax}$ is in the range of 0.5–0.54, with a ratio of a distance $L_m$ from an outlet end of the blade to the blade width $L_{ax}$ being in a range of 0.75–0.89. A ratio of a distance from the maximum projecting point to a line connecting to the outlet end of adjacent blades is in a range of 0.6–0.66. By virtue of the blade profile, the flow velocity differential between the fluid flowing along the front side of the blade and the fluid flowing along the backside of the blade can thereby be reduced.

3 Claims, 17 Drawing Figures

TURBINE BLADE

The present application is a continuation-in-part application of U.S. application Ser. No. 544,727 filed Oct. 24, 1983, now abandoned, which, in turn, is a continuation of U.S. application Ser. No. 129,200, filed Mar. 11, 1980, now abandoned.

BACKGROUND OF THE INVENTION

The present invention relates to high performance high speed blades and, more particularly, to a turbine blade construction.

Blades of, for example, turbines or the like, represent the most important components of the components of a rotary machine in determining turbine efficiency and, consequently, the turbine blade construction has considerable influence on the performance of an electrical power generating plant. Thus, over the years, a number of studies have been conducted in an effort to determine the manner in which the efficiency of a power generating plant can be increased by improving the turbine blade construction.

The aim underlying the present invention essentially resides in providing a turbine blade structure of a high performance which reduces a downstream velocity defect of a turbine blade.

In accordance with advantageous features of the present invention, a turbine blade having a low blade profile loss is provided wherein a crossing point of an inlet angle $\alpha_1$ and an outlet angle $\alpha_2$ of the blade is located in a position in which a distance between a crossing point of an outlet end of the blade is greater than one-half of the blade width $L_{ax}$, with the inlet angle $\alpha_1$ being in the range of between 35°–40°, and the outlet angle $\alpha_2$ being in the range of 25°–28°. A ratio of a narrowest width $S_2$ of the flow channel at the blade outlet end to a narrowest width $S_1$ of a flow channel defined between a back side of the blade in vicinity of the crossing point and a front side of an adjacent blade is $0.81 \leqq S_2/S_1 > 0.96$. A ratio of a distance $l_{ax}$ between a line connecting the outlet ends of adjacent blades and a line passing through the crossing point of the blade width $L_{ax}$ is in a range of 0.5–0.54, with a ratio of a distance $L_m$ from the outlet end of the blade to a maximum projecting point of a back side of the blade in a direction of rotation of the blade to the width $L_{ax}$ is in a range of 0.75–0.89. Additionally, a ratio of a distance from the maximum projecting point to a line connecting the outlet ends of adjacent blades is in a range of 0.6–0.66. By virtue of the above noted features of the present invention, a flow channel defined between the blades does not exhibit any great change in configuration downstream of the flow direction changing point thereby ensuring a minimization of a blade profile loss.

In accordance with further advantageous features of the present invention, the surface of a back side of the blade defining the flow channel is substantially straight at a portion thereof which is downstream of a portion thereof in a vicinity of the crossing point so as to avoid acceleration of the fluid flow along the back side of the blade.

Advantageously, the crossing point may be located in the position in which the distance between the crossing point and outlet end of the blade is less than four-fifth the blade width.

With a turbine blade constructed in accordance with the above noted features, it is possible to utilize such blade in a subsonic range.

Furthermore, with a turbine blade having a width ratio $S_2/S_1$ within the range of 0.81 to 0.96, a flow velocity differential between the fluid flowing along the backside of the blade and the fluid flowing along the front side of the blade can be reduced. Accordingly, it is an object of the present invention to provide a turbine blade structure of high performance which reduces the downstream velocity defect of a turbine blade by minimizing the flow velocity differential between the fluid flowing along the front side of the blade and the fluid flowing along the back side of the blade.

A further object of the present invention resides in providing a turbine blade structure of a low blade profile loss.

Yet another object of the present invention resides in providing a turbine blade construction which is suitable for use in a subsonic range.

A still further object of the present invention resides in providing a turbine blade which is simple in construction and therefore relatively inexpensive to manufacture.

Yet another object of the present invention resides in providing a turbine blade which avoids, by simple means, shortcomings and disadvantages encountered in the prior art.

These and other objects, features, and advantages of the present invention will become more apparent from the following description when taken in connection with the accompanying drawings which show, for the purposes of illustration only, several embodiments in accordance with the present invention.

DETAILED DESCRIPTION

Figure 1:
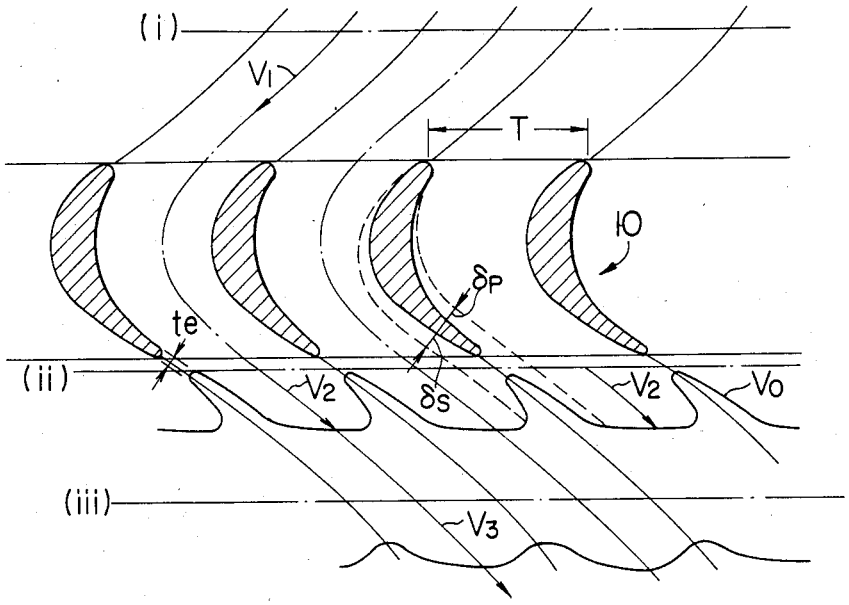
FIG. 1 is a schematic cross-sectional view of a portion of a turbine blade construction depicting a fluid flow through flow channels in a blade cascade.

Referring now to the drawings wherein like reference numerals are used throughout the various views to designate like parts and, more particularly, to FIG. 1, according to this figure, in a cascade of turbine blades 10, the fluid flows uniformly along a testing surface (i) on an upstream side of the cascade and passes at a flow velocity $V_1$, into flow channels in the cascade defined between a plurality of turbine blades 10 and then passes through a testing surface (ii) on a downstream side of the cascade at a flow velocity $V_2$. However, at the testing surface (ii), a velocity loss is produced by the thickness $\delta_s$ and $\delta_p$ of boundary layers built up on surfaces of each turbine blade 10 and the thickness $t_e$ of the blade outlet end of each blade so that a weakened flow of low velocity is produced downstream of each turbine blade 10. The weakened downstream flow, namely, a downstream velocity loss $V_o$, tends to be equalized at a testing surface (iii) further downstream, to have a flow velocity $V_3$. It is the thickness $\delta_s$ and $\delta_p$ of the boundary layers buildup on the surfaces of each turbine blade 10, the thickness $t_e$ of the blade outlet end of each turbine blade 10, and the downstream velocity loss $V_o$ that determine the performance of the cascade of the turbine blades 10. Stated differently, the blade profile performance is evaluated on the basis of a loss caused by friction of the fluid on the surfaces of each turbine blade and a loss caused by an exchange of the momentum between fluid flows for equalizing the downstream velocity defect $V_o$.

Figure 2:
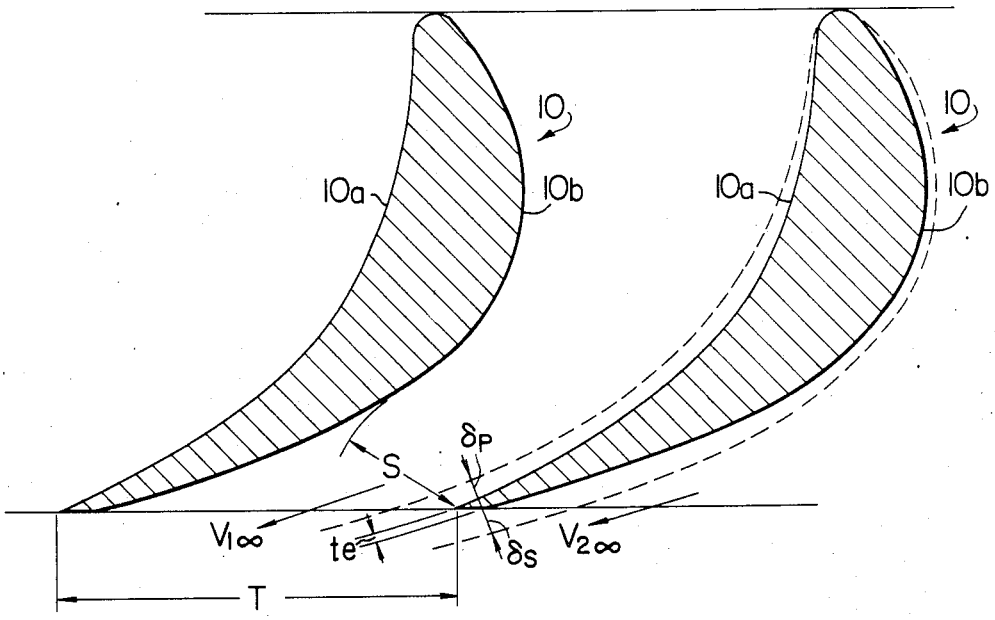
FIG. 2 is a cross-sectional view, on an enlarged scale, of a fluid flow between the turbine blades with respect to boundary layer buildup.

As shown in FIG. 2, previous efforts to improve the performance of a cascade of turbine blades 10 having a throat width S and a blade pitch T have mainly been concentrated on reducing the thickness $\delta_s$ and $\delta_p$ of the boundary layers at the edges of the rear of each blade in order to reduce friction loss and reducing the thickness $t_e$ of the blade outlet end of each blade while maintaining the strength of the blade in an allowable range to thereby reduce the downstream velocity defect $V_o$ and hence to reduce the profile loss; however, this approach has a number of disadvantages.

Figure 3:
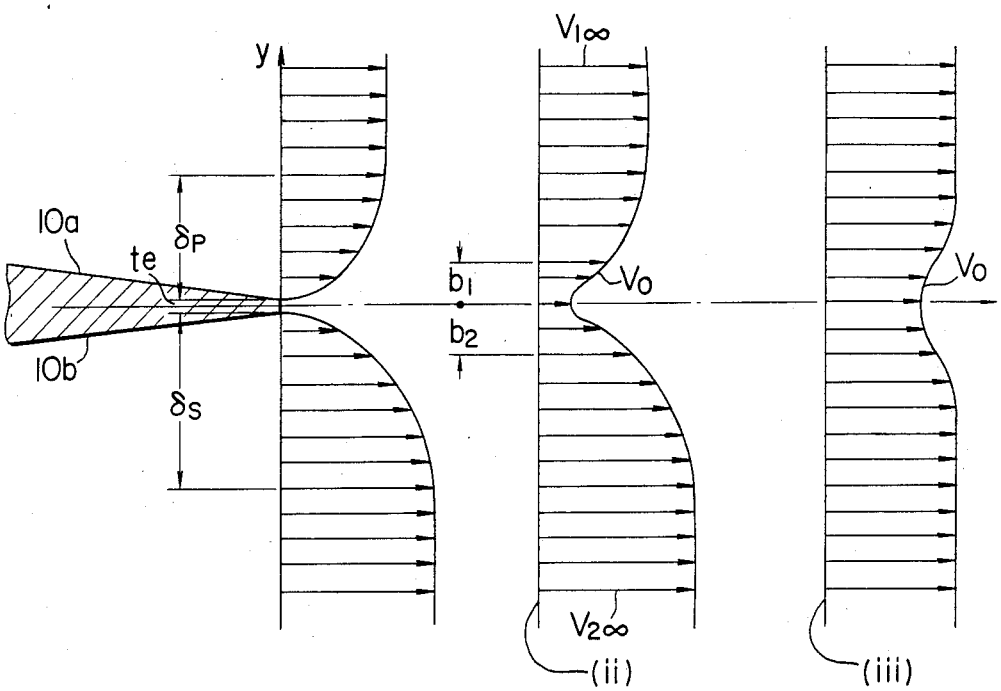
FIG. 3 is a diagrammatic view of a downstream velocity distribution of a turbine blade construction.

More particularly, as shown in FIG. 3, the turbine blades 10 have a velocity $V_{1\infty}$ on a front side 10*a* and a velocity $V_{2\infty}$ on a back side 10*b* with the respective velocities in each turbine blade 10 differing from each other at all times. Previous proposals to improve the turbine blades 10 have not taken into account the fact that the velocity differential influences the downstream velocity defect $V_o$ of each blade 10.

Figure 4:
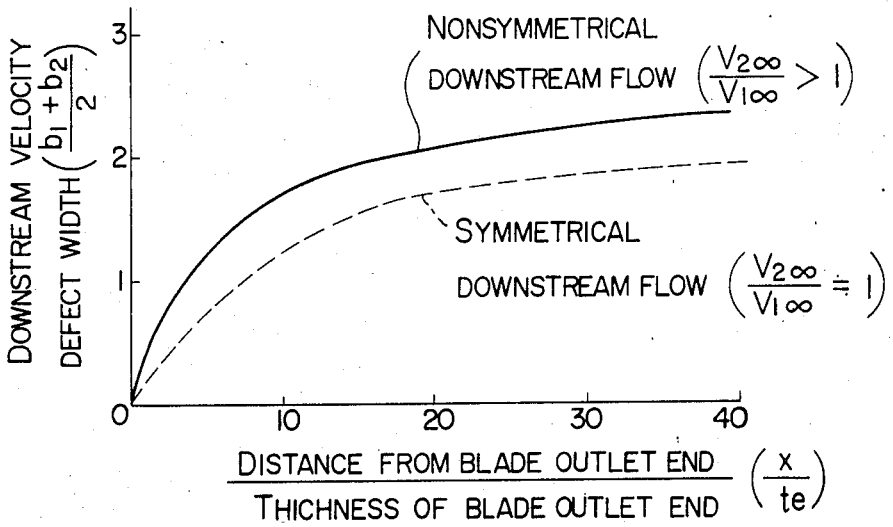
FIG. 4 is a graphical illustration of a relationship between a flow velocity differential between a front side and a back side of a turbine blade and a mean velocity defect range.

FIG. 3 provides an example of a model of the downstream velocity defects $V_o$ which occur when there is a flow velocity differential $V_{2\infty}-V_{1\infty}$ between the front side 10*a* of the turbine blade 10 and the back side 10*b* thereof. As characteristics of a weakened downstream flow, downstream velocity defect widths $b_1$ and $b_2$ were determined in a position in the model of FIG. 3 which corresponds to the testing surface (ii) in FIG. 1, and the relationship between $(b_1+b_2)/2$ and $V_{2\infty}/V_{1\infty}$ was examined, with FIG. 4 diagrammatically illustrating the results of such determinations. As apparent from FIG. 4, the greater the flow velocity differential $V_{2\infty}-V_{1\infty}$ between the front side 10 and back side 10*b* or the nearer the flow velocity differential to a nonsymmetrical weakened downstream flow $V_{2\infty}/V_{1\infty}$ indicated by a solid line, the greater are the ranges of $b_1$ and $b_2$ on the downstream velocity defect $V_o$, thereby reducing the performance of the turbine blade 10.

Figure 5:
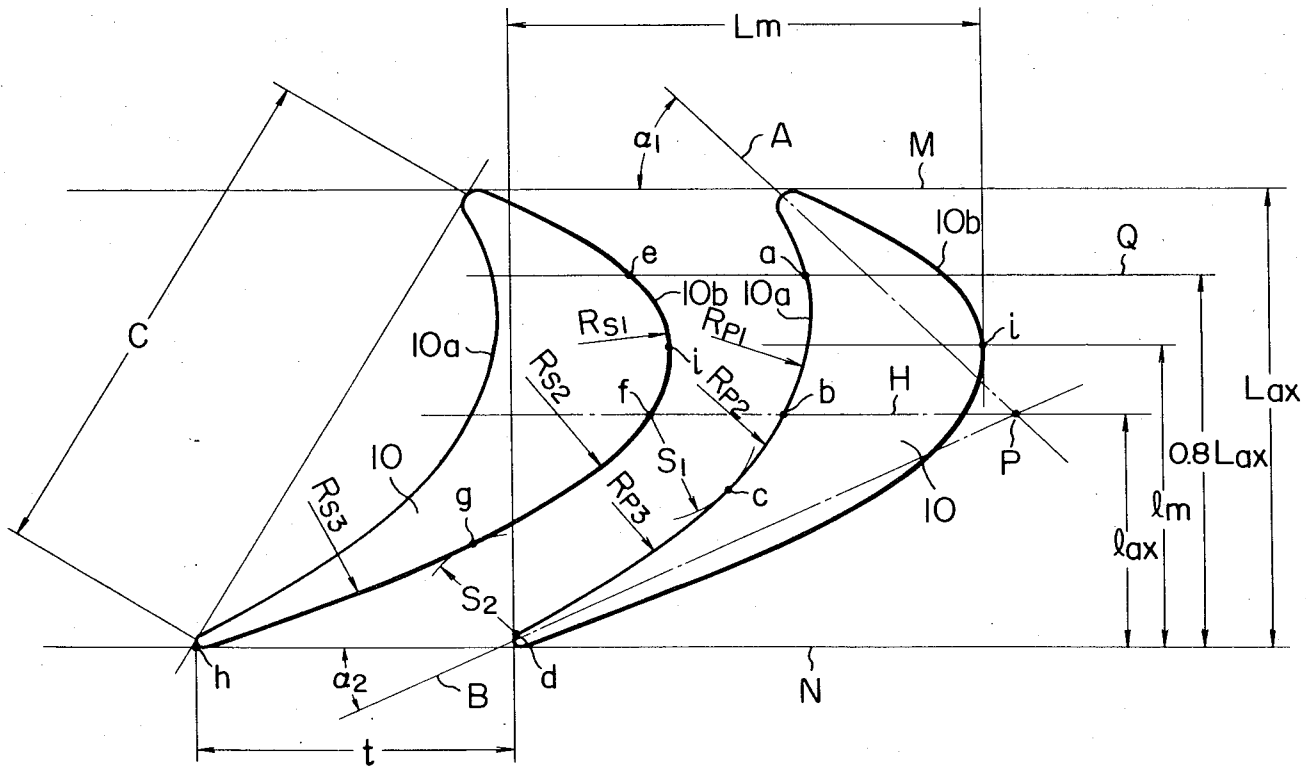
FIG. 5 is a schematic view of a profile of turbine blades constructed in accordance with the present invention.

In accordance with the present invention, as shown most clearly in FIG. 5, the cascade includes a plurality of turbine blades 10 having a turbine blade profile wherein a line H passes through a crossing point P of extensions A and B of an inlet angle $\alpha_1$ of the turbine blade and an outlet angle $\alpha_2$ thereof and parallel to an axis of the cascade of turbine blades 10, a line M connecting the inlet ends of the turbine blades 10. In this connection, the turbine blades 10 are arranged in a circle, and the line H is located in a position which substantially corresponds to a zone or area where the fluid flow, in a flow channel defined between the back side 10*b* of the turbine blade 10 and front side 10*a* of the adjacent turbine blade 10 turns during normal operation.

More particularly, a fluid flowing to the blades, in whatever direction it flows, is caused to become a flow along or in parallel with the blade outlet angle $\alpha_2$ when the fluid is discharged from the blades 10 and, consequently, the fluid must change the flow direction in a flow channel defined between adjacent turbine blades 10. In this situation, the flow direction is, strictly speaking, not abruptly flexed at one point but changes gradually, and the larges change in the flow direction occurs in a vicinity of the line H. Consequently, in the discussion of the instant application, the largest change portion is referred to as the position or point at which the fluid flow changes its direction or the flow direction changing point even though the change in direction occurs in a zone or area of the line H.

In accordance with the present invention, the zone or area where the fluid turning occurs is positioned as far as possible from the blade outlet end in the fluid that has passed through the turning zone or area is not accelerated thereafter so that a differential in flow velocity between a back side 10*b* of a turbine blade 10 and a front side 10*a* is made as small as possible.

The flow channel between adjacent blades has a narrowest width $S_1$ between the turbine blades 10 at a crossing point f of the line H and a back side 10*b* of the blade 10, with the narrowest width $S_1$ being measured at a point C on a front side of the adjacent blade 10. At a blade outlet end, the flow channel has a narrowest width $S_2$ measured between a point d and a point g respectively disposed on the front side 10*a* and back side 10*b* of adjacent turbine blades 10. A line N connects the outlet ends of adjacent turbine blades with a distance between the lines N and H being designated $l_{ax}$, with such distance designating a position of the line H from the blade outlet end. Each of the turbine blades have a blade width $L_{ax}$ which represents a distance between a blade inlet end of the turbine blade 10 and a blade outlet end of the turbine blade 10.

The blade profile of each of the turbine blades 10 is configured so as to satisfy the condition $0.5 \leqq l_{ax}/L_{ax} > 0.54$ with regard to the position of the line H and additionally satisfy the condition of $0.81 \leqq S_2/S_1 > 0.96$ with regard to the flow channel width after the fluid flow changes its direction downstream of the line H.

In the turbine blade profile described hereinabove, the point f at which the fluid flow changes its direction is located on the steam inlet side with respect to the center of the blade width $L_{ax}$, so that acceleration of the fluid flow, i.e., a reduction in pressure, will take place in a portion of the flow channel which is upstream of the point or area at which the fluid flow changes its direction. Thus, the reduction in pressure can be minimized after the fluid flow has changed its direction, by reducing the change in the width of the portion of the flow channel downstream of the flow direction changing zone or area depicted by the point (f) to a level of $0.81 \leqq S_2/S_1 > 0.96$. Consequently, the portion of the flow channel between the flow direction changing point f of the narrowest width $S_1$ and the blade outlet end d of the narrowest width $S_2$ functions as an entrance region for equalizing the flow velocities by reducing the flow velocities differential or pressure differential between the fluid flow along the back side 10*b* and fluid flow along the front side 10*a* of the turbine blades 10. In order to insure the function of the entrance region to be satisfactorily carried out, preferably, the position of the flow direction changing point f, that is, a ratio between $l_{ax}$ and $L_{ax}$ is in the range of 0.5–0.54 or $0.5 \leqq l_{ax}/L_{ax} > 0.54$ thereby providing a flow channel having a sufficient length. More particularly, to enable the acceleration or pressure reduction to take place satisfactorily before the fluid flow changes direction, the flow channel must have a substantial length from the inlet of the flow channel so that $l_{ax}/L_{ax}$ should be less than about 0.54. Additionally, the back side 10*b* of the turbine blade 10 is formed as straight as possible in a portion thereof which is disposed downstream of the flow direction changing zone or area defined by the point f. By virtue of this arrangement, acceleration of the fluid flow which is the general tendency of a fluid flowing along a convex surface can be reduced to thereby equalize the flow velocities by reducing the flow velocity differential or pressure differential between the back side 10*b* and the front side 10*a* of the turbine blade 10 and to reduce the flow velocity differential at the blade outlet end.

Additionally, in FIG. 5, the reference character C represents a chord or a linear distance between the blade inlet end and the blade outlet end, with the angle $\alpha_1$ being and angle formed by a tangential line A at the inlet of a blade camber line and a line M connecting the inlet ends of the adjacent blades. The outlet angle $\alpha_2$ is formed by a tangential line B at the outlet of the blade camber line and the line N connecting the outlet ends of the adjacent blades. The blade pitch is designated by the reference character t, with H representing a line passing through the passing point P of the lines A and B and extending in parallel with the lines M and N. A distance from the outlet end d of a blade to a point i at which the back side 10*b* of the turbine blade 10 most projects in a direction of rotation of the blade measured in a rotation direction in the case of a rotor or moving blade is designated $L_m$ with $l_m$ representing a distance from above the point i to the outlet end line N. The distance from the crossing point f of the line H and the back side 10*b* of the turbine blade to a shortest point c on the front side 10*a* of an adjacent turbine blade 10 is designated by the reference character $S_1$, with $S_2$ representing the distance from the outlet end d to the shortest point g on the back side 10*b* of an adjacent turbine blade 10.

Additionally, as also shown in FIG. 5, an arc between the points a-b has a radius of curvature $R_{p1}$, with an arc between the points b and c having a radius of curvature $R_{p2}$ and arc between points c and d having a radius of $R_{p3}$. The radius of curvature of the arc e-f is designated $R_{s1}$, with the radius of curvature between the points f-g being designated $R_{s2}$, and the radius of curvature of the arc g-h being designated $R_{s3}$. The points a and e represent crossing points of a line Q extending in parallel with the line N at a distance of 0.8 $L_{ax}$ extending through the front side 10*a* and back side 10*b* of the respective adjacent turbine blades 10, with the point b representing a crossing point of the line H and the front side 10*a* of the turbine blade 10.

Advantageously, a ratio between $L_m$ representing the distance from the outlet end d of the turbine blade 10 to the point i to the blade width $L_{ax}$ is in the range of 0.75–0.89, and a ratio between a distance from the point i to the outlet end line N to the blade width $L_x$ is in the range of 0.6–0.66.

Figure 6:
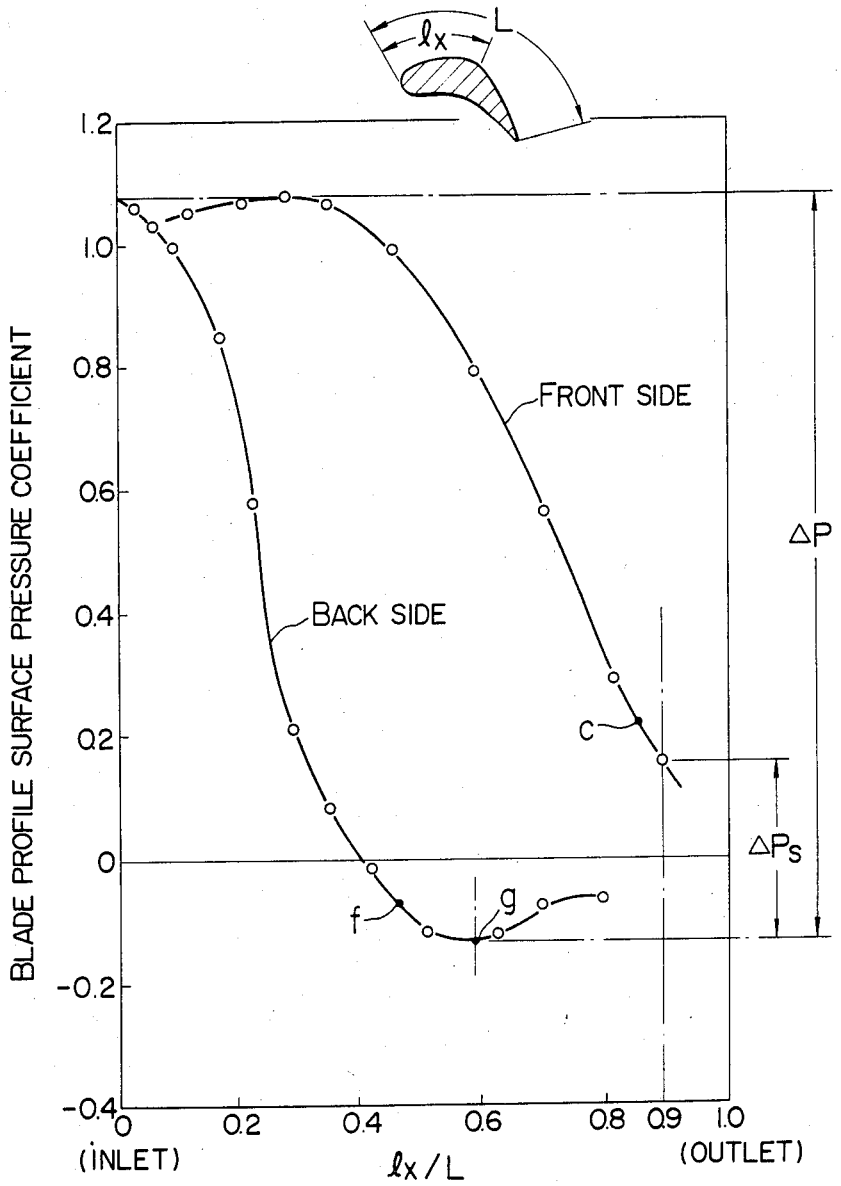
FIG. 6 is a graphical illustration of a distribution of pressure coefficients on the blade profile surface in a turbine blade.

FIG. 6 provides an example of a distribution of blade profile surface pressure coefficients and the flow characteristics of a fluid in the flow channel described hereinabove. The characteristics of the turbine blade 10 according to the present invention clearly illustrate that there is almost no pressure differential between the zone or area defined by the point f on the back side 10*b* of the turbine blade 10 at which the fluid flow changes its direction and the position defined by the point g on the back side of the turbine blade 10 at the throat thereby indicating that the position of the flow channel between the two positions defined by the points f and g performs the function of the entrance region.

If, in FIG. 6, the pressure differential between the blade inlet pressure and the pressure on the back side 10*b* of the turbine blade 10 at the throat is defined by $\Delta P$ and the pressure differential between the pressure on the back side of the blade in the position in which $l_x/L=0.9$ and the pressure on the back side of the turbine blade 10 at the throat is designated by $\Delta P_s$, then a ratio of $\Delta P_s/\Delta P$ is less than 0.2 as clearly evident from FIG. 6. This establishes that the present invention enables the ratio to be reduced substantially by one-half as compared with prior art constructions having a ratio of 0.4. That is, the blade profile according to the present invention is such that the configuration of the flow channel shows no great change downstream of the flow direction changing zone or area defined by the point f where the ratio of $S_2/S_1$ is in the range of 0.81 to 0.96, so that the flow velocity differential between the back side 10*b* of the turbine blade 10 and the front side 10*a* thereof can be reduced in the flow channel portion disposed downstream of the flow direction changing zone or area defined by the point f to thereby provide a turbine blade 10 of high performance having a minimal blade downstream velocity loss, and the blade of such profile can have a distribution of the blade profile surface pressure coefficient shown in FIG. 6.

Figure 7:
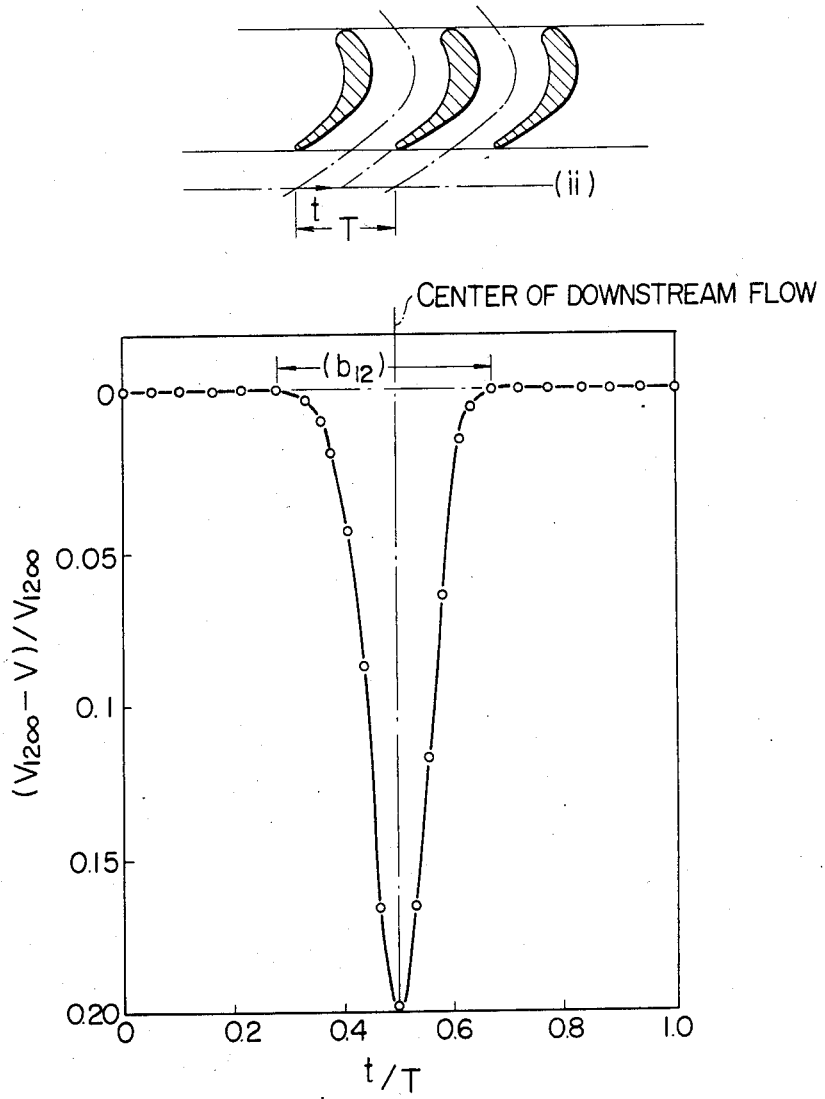
FIG. 7 is a graphical illustration of a flow velocities downstream of a turbine blade.

When the downstream velocity loss of the turbine blade 10 having a blade profile described hereinabove in a position corresponding to the testing surface (ii) shown in FIG. 1 was actually measured, the values obtained indicated that the blade downstream velocity loss was reduced as shown in FIG. 7 in which $V_{12\infty}$ designates the flow velocity on an extension of a center line of the flow channel due to the fact that the flow velocity differential $V_{2\infty}-V_{1\infty}$ between the back side 10*b* of the turbine blade 10 and the front side 10*a* thereof is reduced by virtue of the relationship $\Delta p_s/p<0.2$. More particularly, in FIG. 7, the blade according to the present invention is shown to have its downstream velocity loss range $b_{12}$ reduced to about $t/T=0.37$, so that the blade according to the invention can have its blade downstream velocity loss range $b_{12}$ reduced by about 20% as compared with blades of the prior art. Thus, a significantly great reduction in the blade downstream velocity loss is attainable by a blade profile constructed in accordance with the present invention.

Figure 8:
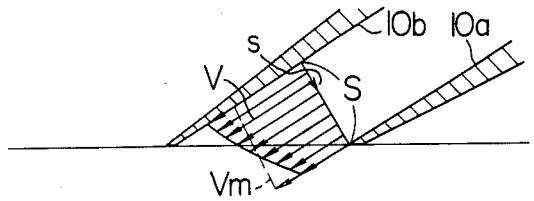
FIG. 8 is a graphical illustration of a distribution of velocities in the flow channel at a blade outlet end.
Figure 8:
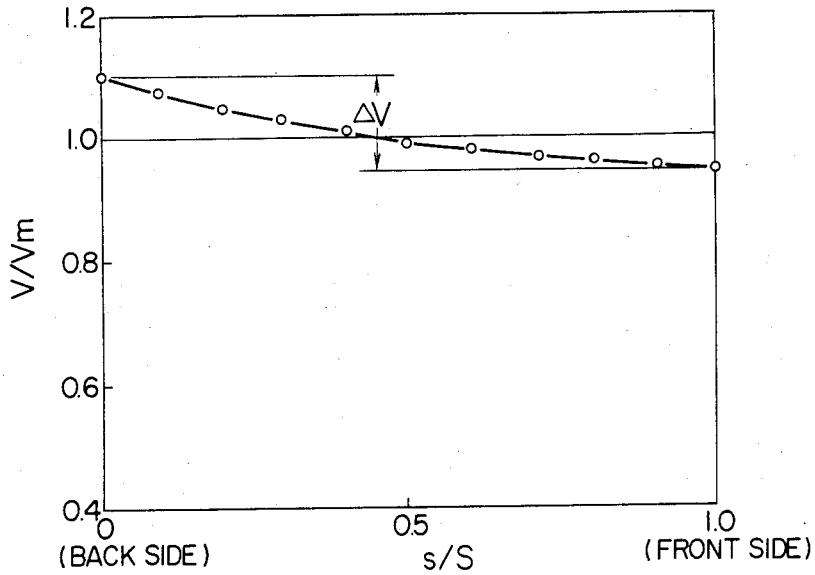

The results of actual measurements of a velocity distribution at the outlet end of the flow channel defined by blades having the improved blade downstream velocity loss in accordance with the present invention are illustrated in FIG. 8. More particularly, as shown in FIG. 8, the velocity differential $\Delta V$ between the back side 10*b* of the blade 10 and the front side 10*a* thereof is depicted in a ratio of actual flow velocity V and means flow velocity $V_m$, which shows that the velocity differential $\Delta V$ is reduced in the turbine blade 10 constructed in accordance with the present invention to about 0.15, which represents about one-half of the turbine blade of the prior art which is 0.3. Consequently, it is evident that the turbine blade 10 according to the present invention enables the flow velocity on the back side 10*b* of the turbine blade 10 to be made close to the flow velocity on the front side 10*a* thereof at the blade outlet end.

Figure 9:
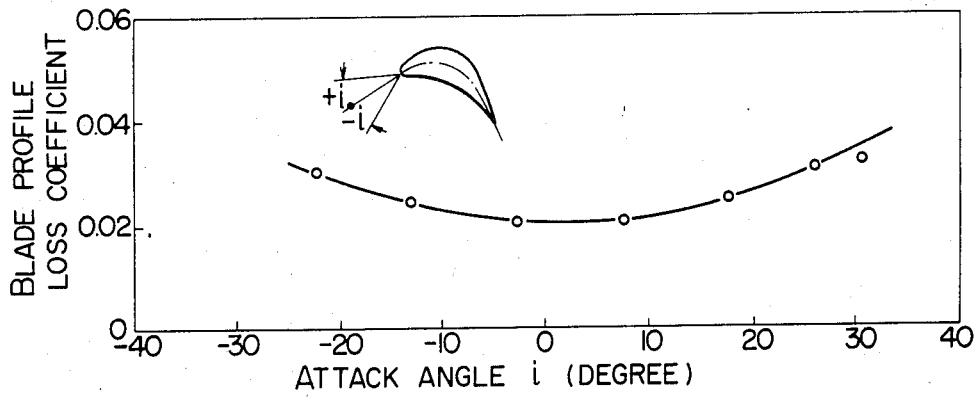
FIG. 9 is a graphical illustration of a relationship between an attack angle of a blade and a blade profile loss coefficient indicating a blade profile performance.

The use of a blade profile provided in accordance with the present invention enables the blade profile surface pressure coefficient distribution to be varied as shown in FIG. 6. Accordingly, as shown in FIG. 9, representing the result of actual measurements of a turbine blade profile, the blade profile loss coefficient can be reduced to a level of less than 0.03. More particularly, as can be seen from FIG. 9, when the attack angle is about 0°, the blade profile loss coefficient can be reduced to about 0.02 which is relatively small. This means that when compared with the corresponding value 0.04 of a turbine blade of the prior art, the blade profile loss coefficient can be greatly reduced by about 0.01–0.02. This reduction in the blade profile loss coefficient indicates that a mixing loss of fluid of the turbine blade outlet end can be reduced by about 30–40% thereby enabling a turbine blade 10 of high performance to be obtained, with the turbine blade 10 being suitable for use in a subsonic range.

One of the advantages offered by the turbine blade 10 of the present invention is that the turbine blade of high performance having reduced blade downstream velocity loss can be readily realized.

Figure 15:
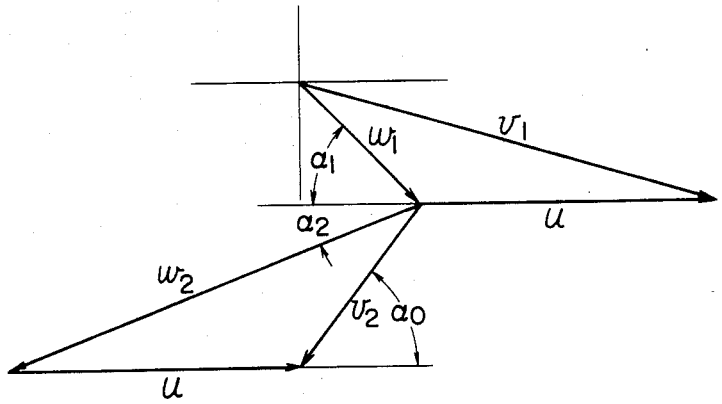
FIG. 15 is a diagram illustrating the relationship between absolute velocity, relative velocity, and the inlet and outlet angles.
Figure 16:
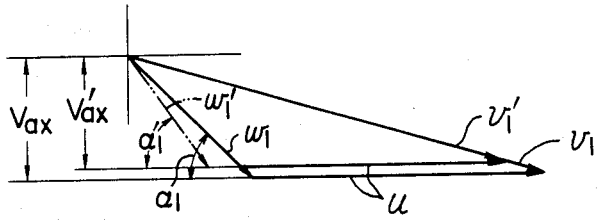
FIG. 16 is a diagramatical illustration depicting a change in flow velocity upon a change in turbine load with a change in the inlet and outlet angle.
Figure 17:
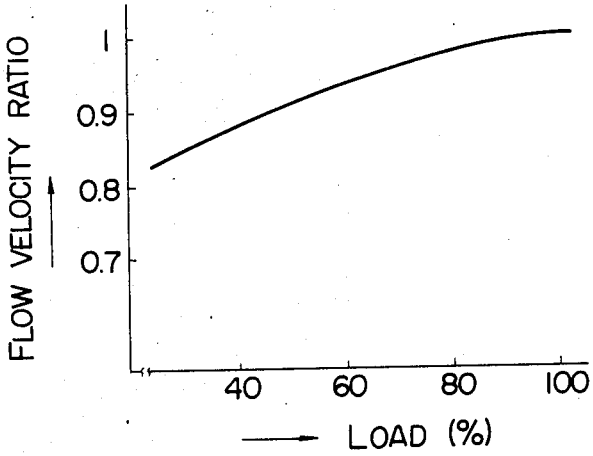
FIG. 17 is a diagram depicting the flow velocity ratio in relationship to the load of the turbine.

Since the turbine to which the present invention is directed is for, for example, a power plant turbine which is operated at a constant speed, it is of significance to consider the inlet angle $\Delta_1$ and the outlet angle $\Delta_2$. Generally, in such a turbine, the construction is such that the direction of inflow of the fluid during normal operation is caused to coincide with the inlet angle $\alpha_1$. When the principles involved in the present invention are utilized on a moving tubine blade, as shown in attached FIG. 15, if the absolute velocity $v_1$ at the outlet and the stationary blade and the rotational speed u of the moving turbine blade 10 are provided, the relative velocity $w_1$ at the inlet of the moving blade is obtained from a velocity triangle so that the inlet angle $\alpha_1$ can readily be determied. Subsequently, the absolute velocity $v_2$ at the outlet of the moving turbine blade is determined as being in a direction in accord with the inlet angle $\alpha_0$ of a stationary blade and, consequently, the relative velocity $w_2$ is obtained so that the outlet angle $\alpha_2$ of the moving blade can be determined. If a change in the turbine load occurs, and the flow velocity in an axial direction of the tubine changes from $V_{ax}$ to $V'_{ax}$, a change from $\alpha_1$ to $\alpha'_1$ occurs as shown most clearly in attached FIG. 16, with the same also applying to the outlet angle $\alpha_2$. However, in a turbine, the reduction in load would cause the reduction in pressure of fluid such as, for example, steam, which leads to an increase in volume and, therefore, the extent of the reducution in velocity would not be so great in comparison with the extension of the reduction of the load. FIG. 17 provides an example of a flow velocity $V'_{ax}$ in a partial load operation as a ratio of the flow velocity $V_{ax}$ in the 100% load when the value of $V_{ax}$ is equal to one. As apparent from FIG. 17, if $V'_{ax}$ is 0.85 even at a 30% load, and, therefore, even if the angle $\alpha_1$ at 100% load is used to determine the blade inlet angle, the performance at a partial load is not significantly reduced.

With regard to the procedure for determining the blade profile, $\alpha_1$, $\alpha_2$, t, and $L_{ax}$ are previously determined so as to provide for specific values and, therefore, as one method, $l_{ax}/L_{ax}$ is determined by selecting one value within a range of values defined in the present invention. For example, if 0.5 is selected, the value of $L_{ax}$ can readily be determined.

From $L_{ax}$, t, $\alpha_1$, $\alpha_2$, and $l_{ax}$, as well as the lines M, H, and N with the points H and D in FIG. 5 being determined and, from the points h and d the line B is drawn in dependence upon $\alpha_2$. The crossing point P of the lines B and H is obtained and, from that point, the line A is drawn based on $\alpha_1$.

To determine the point i the values of $L_m/L_{ax}$ and $l_m/L_{ax}$ are selected so as to be in the above defined ranges. If, for example, 0.8 and 0.6 are selected, the values of $L_m$ and $l_m$ are obtained so that the position of the point i can readily be determined.

Next the value of $S_2/S_1$ is selected to be, for example, 0.85, and the value of $S_2$ is assumed from the above described $W_1$ and $W_2$ so that the values $S_1$ and $S_2$ are determined, with the determined value of $S_2$ making it possible to readily determine the point g and from the points h, g, and i the point f can readily be determined, with the determined point f making it possible to then determine the point c based on the value $S_1$.

If a rough blade profile is determined in such a manner, the final blade profile is determined by connecting the respective points using smooth curved planes. In this situation, since a portion of the values are assumed, trials of combining any assumed values in a number of ways within the above-mentioned range are carried out in order to obtain the most appropriate blade profile.

Additionally, it has been determined that, among the values of radii of curvature shown, the most effecting the performance are $R_{p3}$ and $R_{s3}$, and it is preferable to make straight the flow channel on the blade outlet side.

The following table provides a summary of the specific relationships for the tubine blade profile construction in accordance with the present invention as depicted in FIGS. 10–14 and as compared with the prior art of FIG. 2.

TABLE

Figure 10:
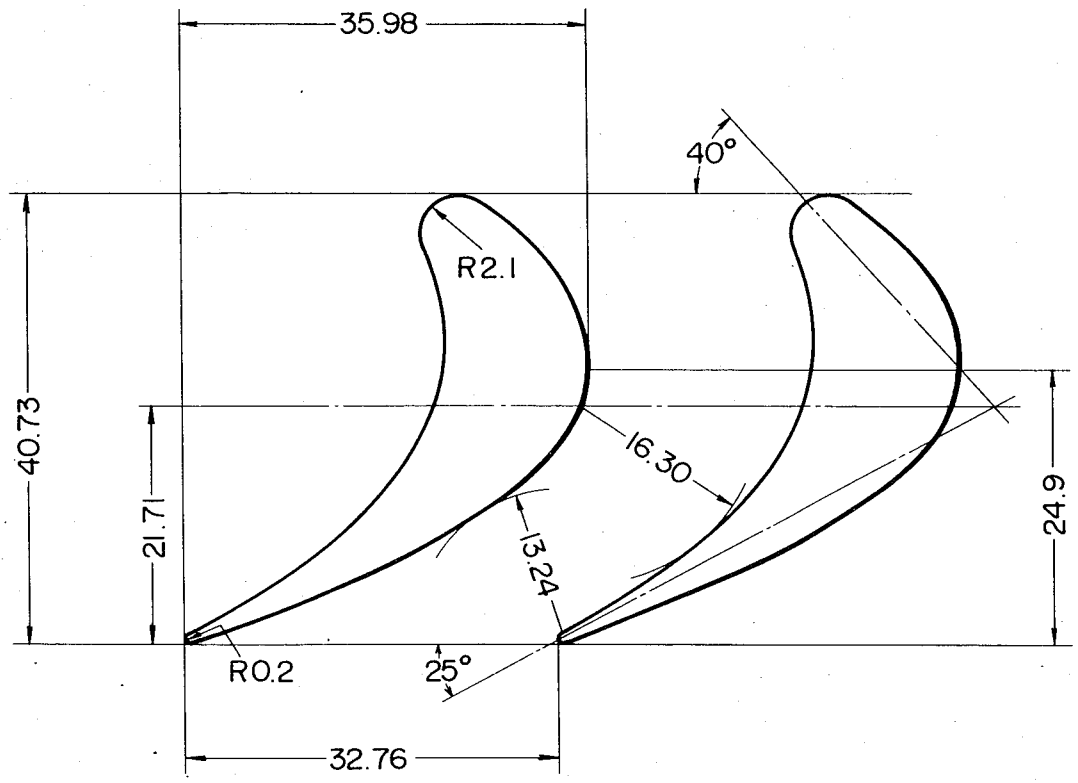
FIGS. 10 through 14 are schematic views of profiles of additional turbine blades constructed in accordance with the present invention.
Figure 11:
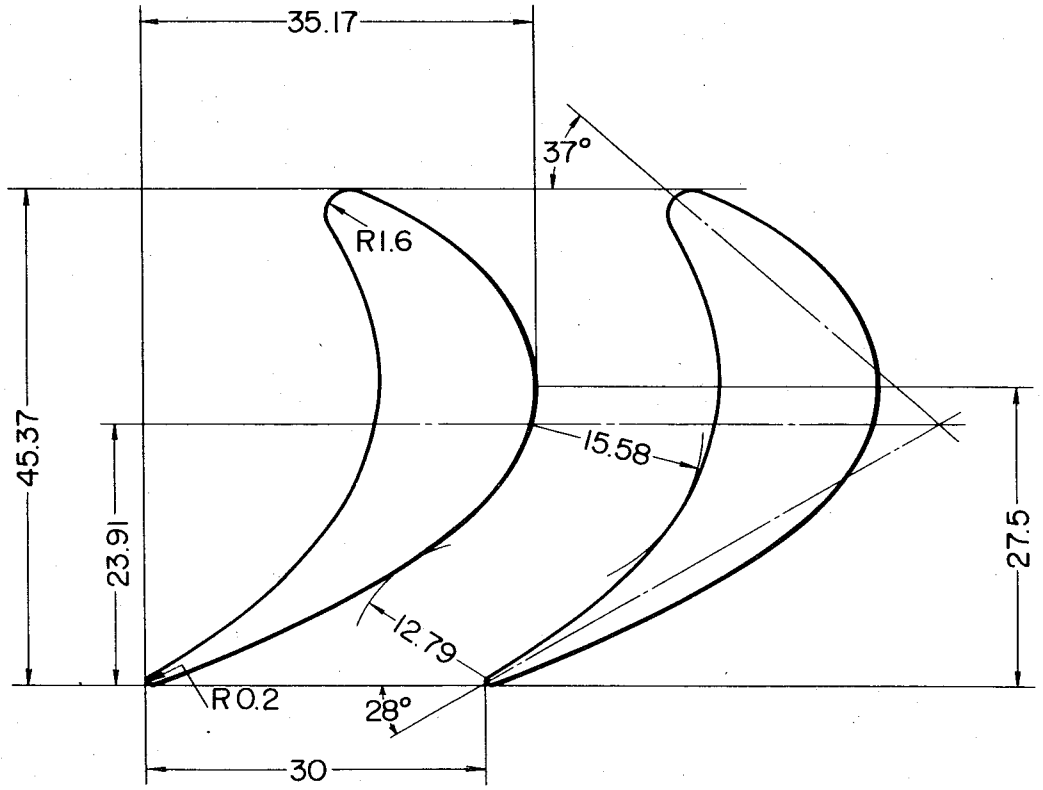
Figure 12:
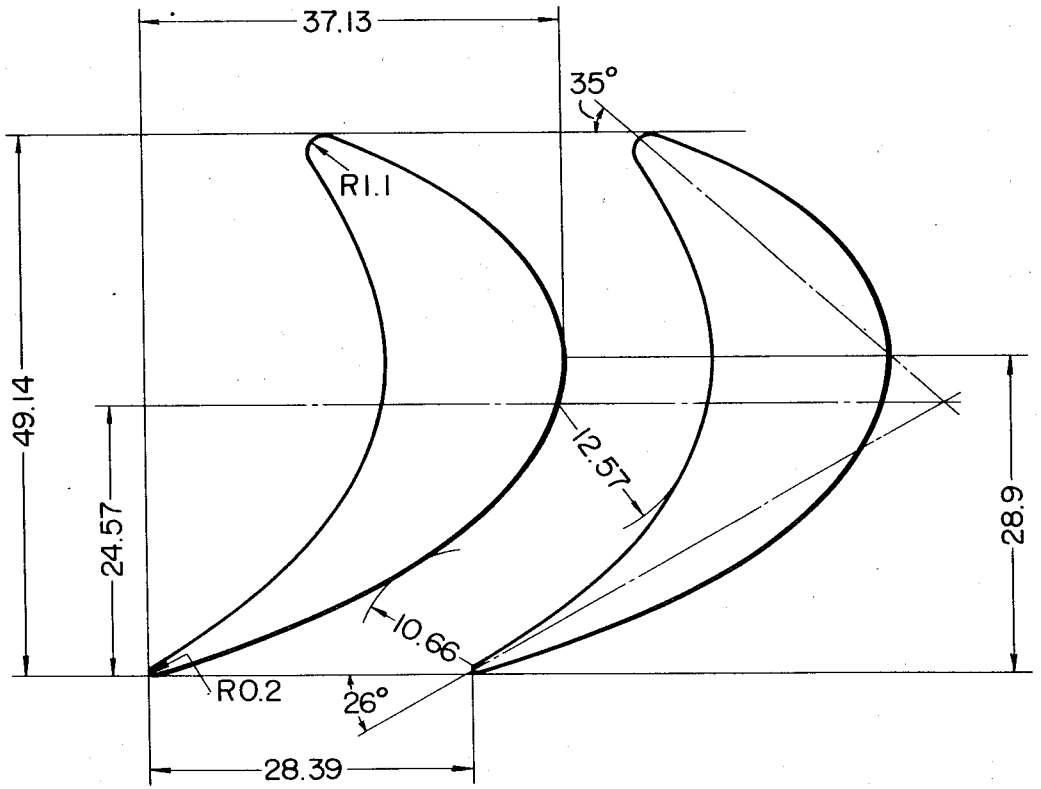
Figure 13:
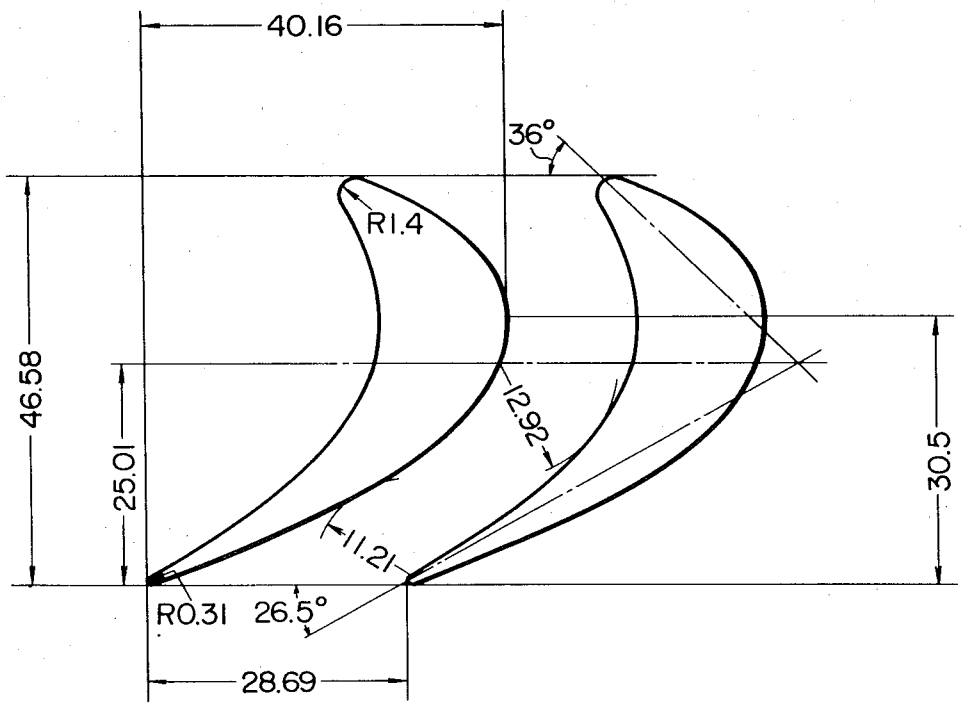
Figure 14:
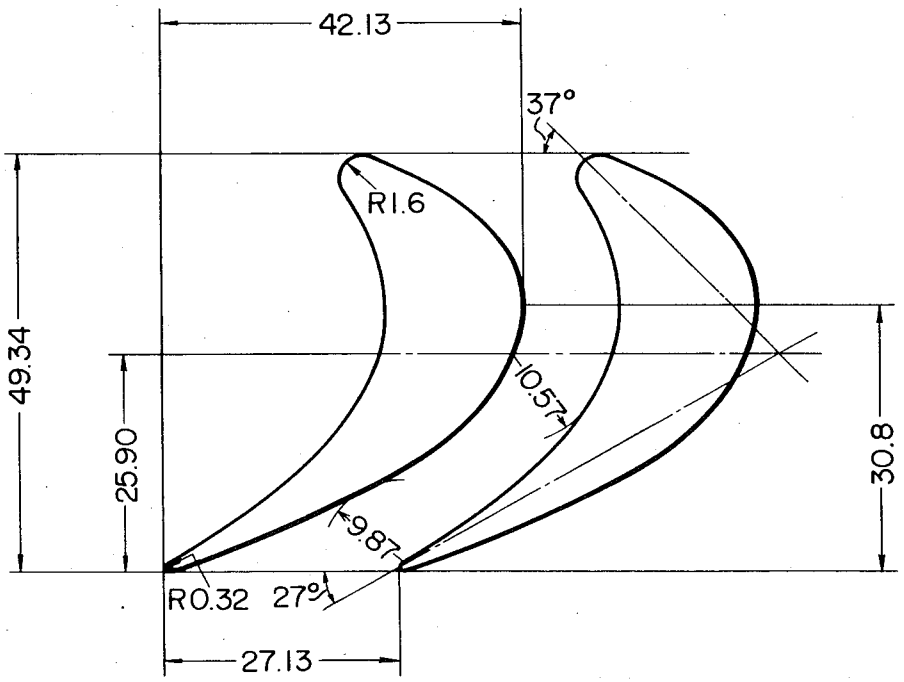

| | FIG. 10 | FIG. 11 | FIG. 12 | FIG. 13 | FIG. 14 | Range | Prior Art (FIG. 2) |
|---|---|---|---|---|---|---|---|
| $\frac{lax}{Lax}$ | 0.533 | 0.527 | 0.500 | 0.537 | 0.524 | 0.5~0.54 | 0.409 |
| $\frac{S_2}{S_1}$ | 0.812 | 0.821 | 0.848 | 0.868 | 0.934 | 0.81~0.94 | 0.776 |
| $\frac{L_m}{Lax}$ | 0.883 | 0.775 | 0.756 | 0.862 | 0.854 | 0.75~0.89 | 0.795 |

TABLE-continued

| | FIG. 10 | FIG. 11 | FIG. 12 | FIG. 13 | FIG. 14 | Range | Prior Art (FIG. 2) |
|---|---|---|---|---|---|---|---|
| $\frac{l_m}{Lax}$ | 0.611 | 0.606 | 0.588 | 0.654 | 0.624 | 0.6~0.66 | 0.606 |
| $\frac{R_{p1}}{C}$ | 0.482 | 0.488 | 0.484 | 0.473 | 0.429 | 0.43~0.49 | 0.554 |
| $\frac{R_{p2}}{C}$ | 0.542 | 0.465 | 0.430 | 0.405 | 0.403 | 0.4~0.55 | 0.554 |
| $\frac{R_{p3}}{C}$ | 1.325 | 1.047 | 0.968 | 1.486 | 1.141 | >0.95 | 0.554 |
| $\frac{R_{s1}}{C}$ | 0.301 | 0.291 | 0.269 | 0.270 | 0.268 | 0.26~0.31 | 0.377 |
| $\frac{R_{s2}}{C}$ | 0.542 | 0.558 | 0.591 | 0.608 | 0.644 | 0.54~0.65 | 0.377 |
| $\frac{R_{s3}}{C}$ | 3.253 | 3.023 | 2.796 | 3.649 | 3.624 | >2.7 | 2.558 |
| $\alpha_1$ | 40° | 37° | 35° | 36° | 37° | 35°~40° | 44° |
| $\alpha_2$ | 25° | 28° | 26° | 26.5° | 27° | 25°~28° | 24° |
| $\alpha_1 + \alpha_2$ | 65° | 65° | 61° | 62.5° | 64° | 61°~65° | 68° |

While we have shown and described several embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A turbine blade of a low blade profile loss wherein a crossing point of an inlet angle $\alpha_1$ and an outlet angle $\alpha_2$ of the blade is located in a position in which the distance between the crossing point of an outlet end of the blade is greater than one-half of a blade width $L_{ax}$, the inlet angle $\alpha_1$ is in a range of between 35°–40°, the outlet angle $\alpha_2$ is in a range of 25°–28°, and a ratio of a narrowest width $S_2$ of the flow channel at the blade outlet end to a narrowest width $S_1$ of a flow channel defined between a backside of the turbine blade in a vicinity of the crossing point and a front side of an adjacent blade is $0.81 \leqq S_2/S_1 < 0.96$, a ratio of a distance $l_{ax}$ between a line connecting the outlet ends of adjacent blades and a line passing through the crossing point to the blade width $L_{ax}$ is in a range of 0.5–0.54, a ratio of a distance $L_m$ from the outlet end of a blade to a maximum projecting point of a backside of the blade in a direction of rotation of the blade to the width $L_{ax}$ is in a range of 0.75–0.89, and wherein a ratio of the distance from the maximum projecting point to the line connecting the outlet ends of adjacent blades is in the range of 0.6–0.66.

2. A turbine blade as claimed in claim 1, wherein a surface of the backside of the blade defining the flow channel is substantially straight in a portion thereof which is downstream of a portion thereof in a vicinity of the crossing point, so as to avoid acceleration of the fluid flowing along the backside of the blade.

3. A turbine blade as claimed in claim 1, wherein the crossing point is located in a position in which a distance between the crossing point and the outlet end of the blade is less than four-fifths of a width of the blade.

* * * * *